United States Patent [19]

Baxter

[11] 3,955,690

[45] May 11, 1976

[54] DUNNAGE BAG END CLOSURE

[75] Inventor: Robert O. Baxter, Camden, Ark.

[73] Assignee: International Paper Company, New York, N.Y.

[22] Filed: Sept. 23, 1974

[21] Appl. No.: 508,156

[52] U.S. Cl. ..... 214/10.5 D; 105/468

[51] Int. Cl.[2] ..... B65G 1/14

[58] Field of Search ..... 214/10.5 D; 105/468; 9/314–327; 5/348 R; 206/522, 814

[56] References Cited

UNITED STATES PATENTS 3,365,116 1/1968 Ludlow ..... 229/55

3,556,318 1/1971 Hollis ..... 214/10.5 D

*Primary Examiner*—Frank E. Werner

*Attorney, Agent, or Firm*—Alfred L. Michaelsen

[57] ABSTRACT

Disclosed is a multi-wall dunnage bag wherein at least one end of the bag is closed by flaps which extend around the end of the bag and are adhesively secured to the plies which form the bag wall. The end of the outermost flap is disposed beneath the outermost ply and is adhesively secured thereto by the use of a thermally activated adhesive. The outermost flap and the penultimate flap may be secured together. Additionally, a conventional adhesive material connects the outermost ply with an adjacent portion of the bag.

10 Claims, 6 Drawing Figures

DUNNAGE BAG END CLOSURE

BACKGROUND OF THE INVENTION

Dunnage bags are commonly used in the transportation industry to insure that large articles packed within a vehicle, such as a railroad car or a truck, are not damaged during shipment as a result of a mechanical shock. For example, when large articles are packed within a crate and such crates are placed within a railroad car, the articles contained within the crates might be damaged when the railroad car was coupled to a train. To minimize the possibility of articles being damaged in this manner, a small space may be left between each crate. In each of these spaces, an inflatable bag may be disposed and inflated so as to provide, in effect, a pneumatic cushion between each of the crates and between the crates and the walls of the freight car.

Initially, dunnage bags were constructed of heavy guage, rubberized material, so as to withstand the mechanical stresses to which they were subjected. However, the cost of such dunnage bags was sufficiently high as to require their re-use. Since the re-use of a dunnage bag often required the reshipping thereof to a point of origin or the storage of such bags for future use, it was conceived that a need existed for disposable dunnage bags. As a result, dunnage bags were developed which employed relatively light weight, thermoplastic bladders encased within a number of plies of paper. In such a construction, the light weight, thermoplastic bladder retained the air used for inflation and the plurality of papers plies supplied the required strength.

Prior Art

Disposable dunnage bags of the type discussed above generally employ a plurality of paper plies, each of which may be longitudinally, adhesively secured together. The prior art discloses that the ends of disposable dunnage bags may be closed through the use of a variety of constructions. However, whatever type of end closure construction is employed, it must satisfy a number of requirements, the primary one of which is that sufficient strength must be provided to support the bladder and withstand the substantial forces which are exerted by the bladder, upon the paper plies, when the bag is inflated.

For example, referring to FIG. 1 of the drawings, there is shown an end closure construction for a dunnage bag as disclosed in U.S. Pat. Re No. 27,787. In a dunnage bag of the type shown in FIG. 1, a bladder 12 is disposed between the two multiply walls 25 and 26 of the bag. As may be seen in FIG. 1, the plies which form the first wall 25 include flaps which extend around the end of the bag and are adhesively secured to selected plies of the other wall 26. Thus, the wall 25 includes outer plies 27 and 15 and integral therewith and extending therefrom are flaps 21, 22, respectively. The inner surface of flaps 21 and 22 are adhesively secured to the outer surfaces of plies 20, 16.

As shown in FIG. 1, the outer surface of the outer plies 20, 27 and the outer surface of the flap 21 are generally coated with a thermoplastic material 11, for example, polyethylene, in order to make the bag water resistent. Since the outer surface of the ply 20 is thermoplastically coated, it will be appreciated that the adhesive bond 24 does not connect directly with the ply 20. Rather, the adhesive connection 24 connects the inner surface of the flap 21 to the thermoplastic coating on the ply 20. In view of this fact, it has been the practice in the prior art to use a hot melt glue to provide the adhesive connection 24 since the use of a standard adhesive, e.g. a starch composition, would generally not satisfactorily bond to a thermoplastic surface. Thus, although a standard adhesive such as a starch composition is generally used to adhere the inner flaps to respective plies of the other wall 26, the use of a hot melt adhesive is generally resorted to inorder to secure the outer flap 21 to the outer ply 20.

Experiments conducted on the occasion of this invention have determined that although the hot melt adhesive connection 24 usually performs in a satisfactory manner, generally unsatisfactory performance is displayed when a bag of the type partially shown in FIG. 1 is inflated and is subjected to relatively high ambient temperatures, for example, temperatures in excess of 100°. In the presence of such elevated temperatures, it has been found that the hot melt bond 24 often displays a creep phenomenon, i.e. the hot melt bond will permit a slow but continuous movement of the outermost flap with respect to the outermost ply and ultimately the bond will fail.

Referring to FIG. 2 of the drawings, there is shown another prior art end closure for a dunnage bag wherein a plurality of flaps (6 flaps in the emobidment of FIG. 2) are used to form the end closure. U.S. Pat. No. 3,556,318, which discloses the construction of FIG. 2, recites that the outer surface of the outermost plies may be coated with a thermoplastic material. Thus, in a construction of the type shown in FIG. 2, a similar creep phenomenon may be encountered when a bag having this type of enclosure is inflated and subjected to an elevated temperature.

The invention disclosed herein has been found to provide a secure bond, at elevated temperatures, which does not display a creep phenomenon.

SUMMARY OF THE INVENTION

In combination with a dunnage bag wherein at least one end of the bag is closed by a plurality of flaps which are adhesively secured to the plies which form one wall of the bag, the outermost flap is disposed beneath the outermost ply and is secured thereto by a thermally activated adhesive, i.e. either a heat seal connection or a hot melt adhesive connection. The outermost flap and the penultimate flap are secured together and the inner surface of the penultimate flap is secured to the outer surface of the penultimate ply. In addition, a fourth adhesive connection is provided between the inner surface of the outermost ply and the portion of the bag adjacent to the end of said flaps.

In the preferred embodiment of my invention, the inner surface of the outermost flap is adhesively secured to the outer surface of the penultimate flap through the use of a standard adhesive and the aforementioned fourth adhesive connection connects the inner surface of the outermost ply to the outer surface of the penultimate ply. In an alternate embodiment of my invention, the inner surface of the outermost ply is adhesively connected to the outer surface of the outermost flap.

DETAILED DESCRIPTION OF PREFERRED EMBODIMENTS

Figure 3:
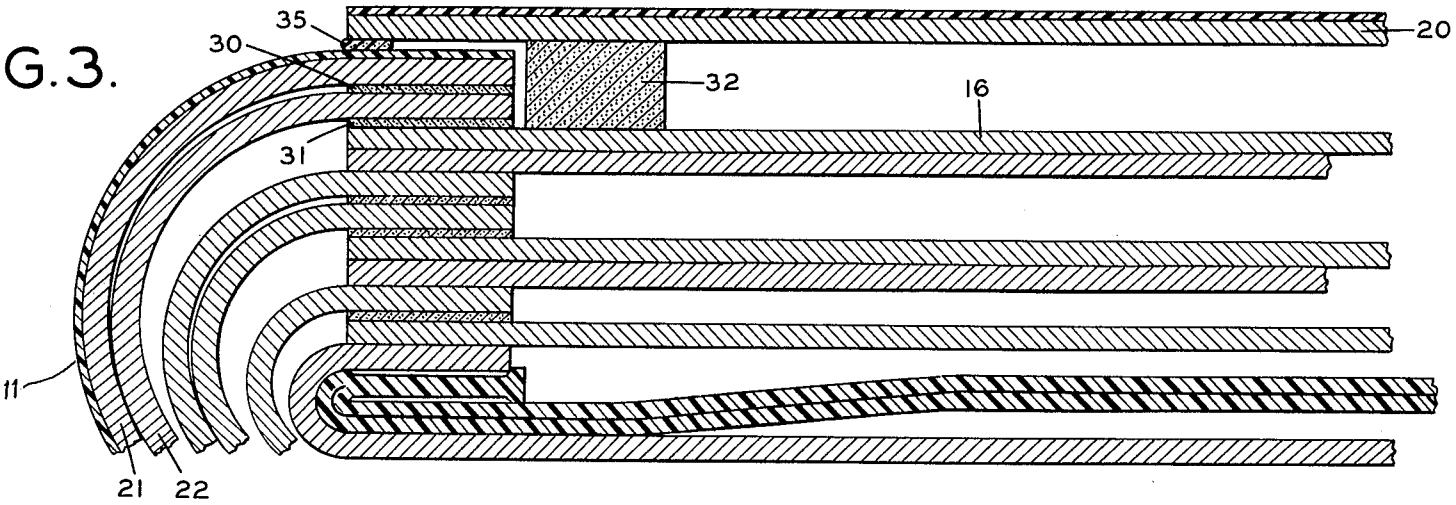
FIG. 3 is a fragmentary view, in section, of a preferred embodiment of my invention.

Referring to FIG. 3, there is shown a fragmentary view, in section, of a dunnage bag which incorporates the instant invention.

Figure 1:
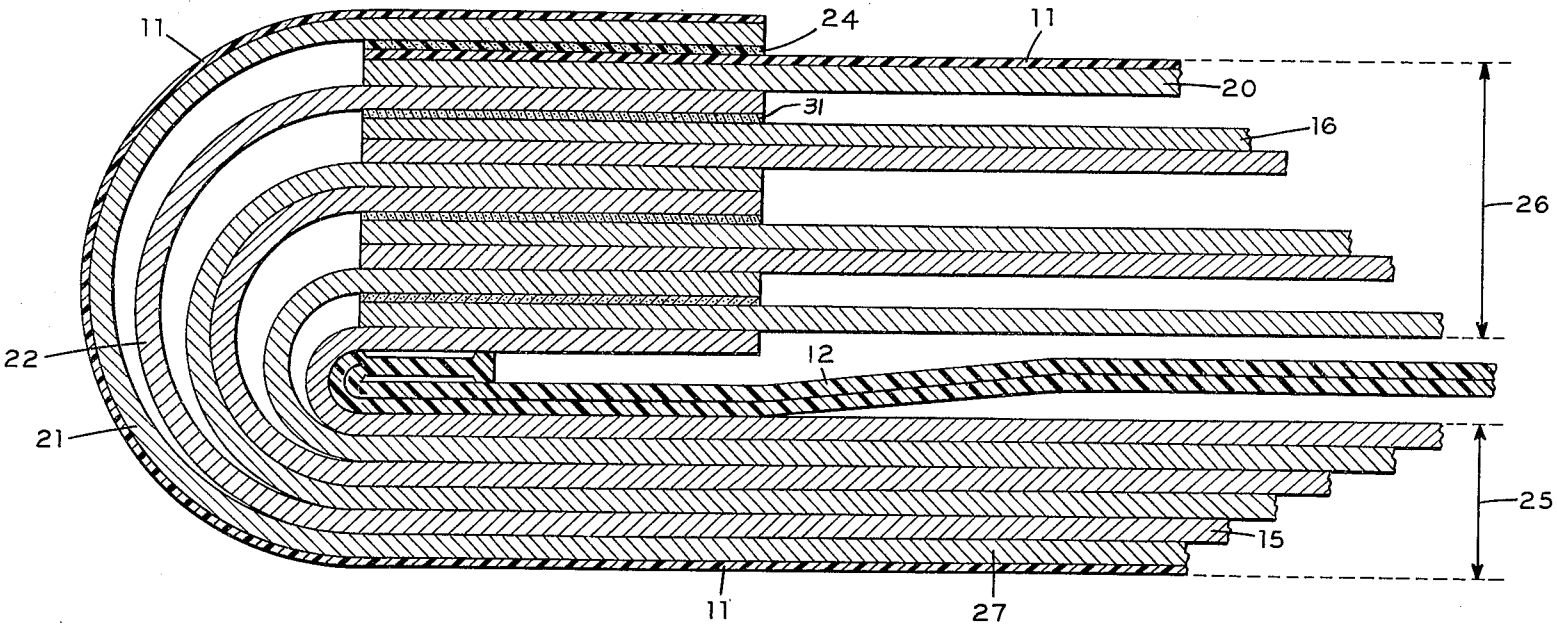
FIG. 1. PRIOR ART
FIG. 1 is a fragmentary view, in section, of a prior art, end closure construction for a dunnage bag.
Figure 2:
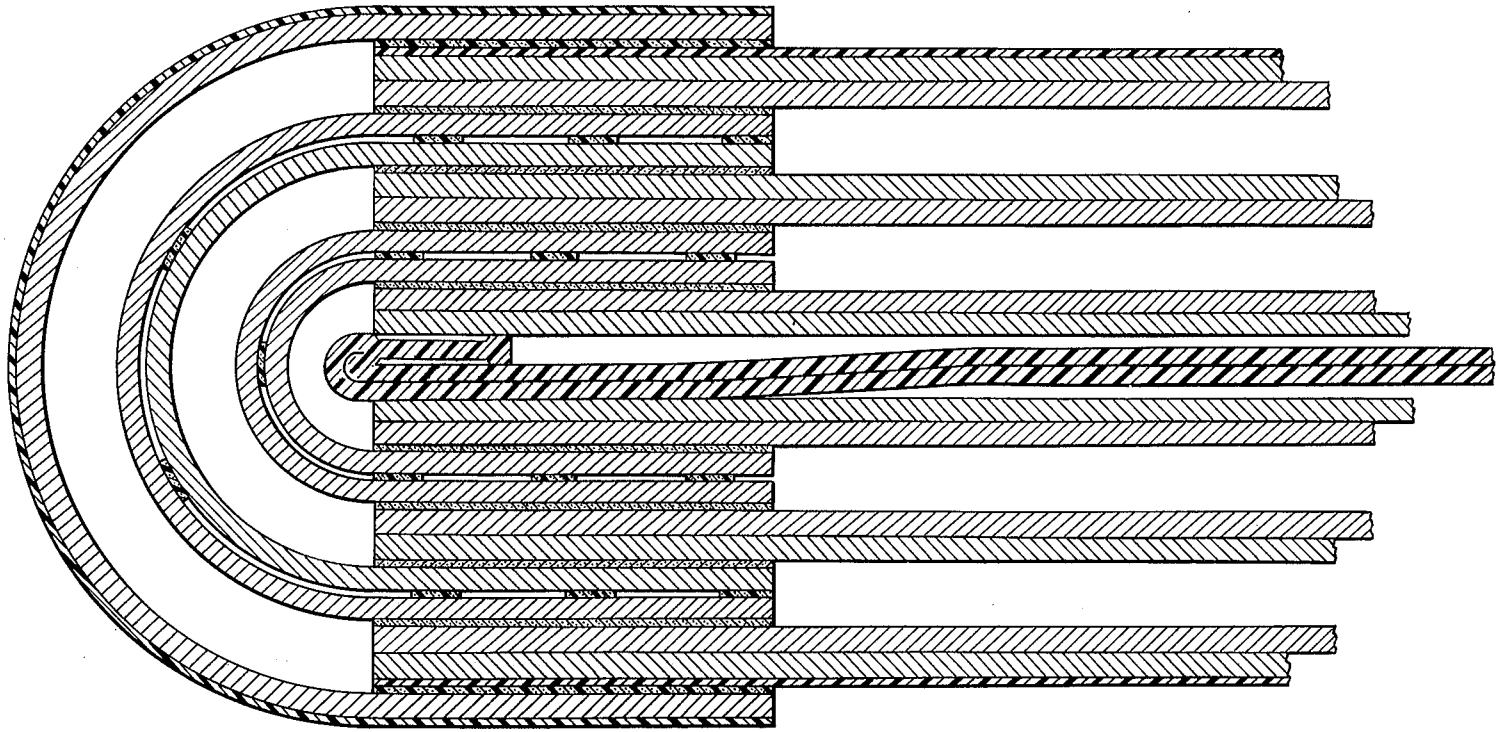
FIG.2. PRIOR ART
FIG. 2 is a fragmentary view, in section, of another prior art, end closure construction for a dunnage bag.

It will be seen that FIG. 3 is generally similar to the upper half of the prior art constructions shown in FIGS. 1 and 2. However, in accordance with the instant invention, it will be noted that the outermost flap 21 is disposed interiorly of the outermost ply 20. Additionally, the inner surface of the outermost flap 21 is preferably adhesively bonded, as at 30, to the outer surface of the penultimate flap 22 adjacent the end of these flaps. The interior surface of the penultimate flap 22 is bonded to the outer surface of the penultimate ply 16 as at 31. In accordance with my invention, the adhesive bonds 30 and 31 are not hot melt type bonds. Rather, a standard adhesive is employed to achieve these bonds, e.g. a starch adhesive of a PVA composition.

Considering the outermost ply 20, two adhesive connections are provided. First, a hot melt adhesive provides an adhesive connection 35 between the interior surface of the outermost ply 20 and the exterior surface of the outermost flap 21. Additionally, a second adhesive connection 32 is provided between the interior surface of the outermost ply 20 and the adjacent portion of the dunnage bag. Thus, in accordance with the preferred embodiment of my invention, the interior surface of the outermost ply 20 is bonded directly to the exterior surface of the penultimate ply 16 by the adhesive connection 32 which, once again, is a non-hot melt adhesive, e.g. a starch composition or a PVA composition.

The phrase "hot melt adhesive" is believed to be well known and understood by those skilled in the art to which this invention pertains. In general, such an adhesive is a thermoplastic polymer, for example, the adhesive sold by Eastman Chemical Company under the designation F-8.

Experiments conducted upon dunnage bags having an end closure construction as shown in FIG. 3 indicate that this construction provides a secure end closure at elevated temperatures, i.e. this construction does not fail at elevated temperatures as a result of creep phenomenon. With this construction, creep is apparently avoided by the combination of the adhesive connection 30 between the outermost flap and the penultimate flap and the adhesive connection 32 between the outermost ply and the penultimate ply, wherein both of these adhesive connections are non-hot melt adhesives. It may be noted that through the use of this construction non-hot melt adhesives may be employed since all of the aforementioned adhesive connections are between paper surfaces, i.e. these adhesive connections do not connect any thermoplastic coated paper surfaces.

Although the above described adhesive connection construction solves the creep-failure problem, it should be noted that the presence of the hot melt adhesive connection 35 between the outer surface of the outermost flap 21 and the inner surface of the outermost ply 20 is also required. The requirement for this hot melt connection arises because of the nature of the manufacturing process employed to produce such bags. Thus, during the manufacturing process, an outward force may be exerted upon the flaps which form the end closure of the bag. As such, it is important to insure that at least the outermost flap is quickly bonded to the outermost ply. If only a standard adhesive were employed (an adhesive which was not thermally activated) a quick setting bond would not be provided and the slow setting standard adhesive bond would fail because of the applied forces. By providing a heat activated adhesive connection, e.g. a hot melt adhesive, the connection between the outermost flap and the outermost ply, as shown at 35 in FIG. 3, the position of the outermost flap is quickly fixed and, thereby, sufficient time may be provided to prermit the non-hot melt adhesive connections to set.

Figure 4:
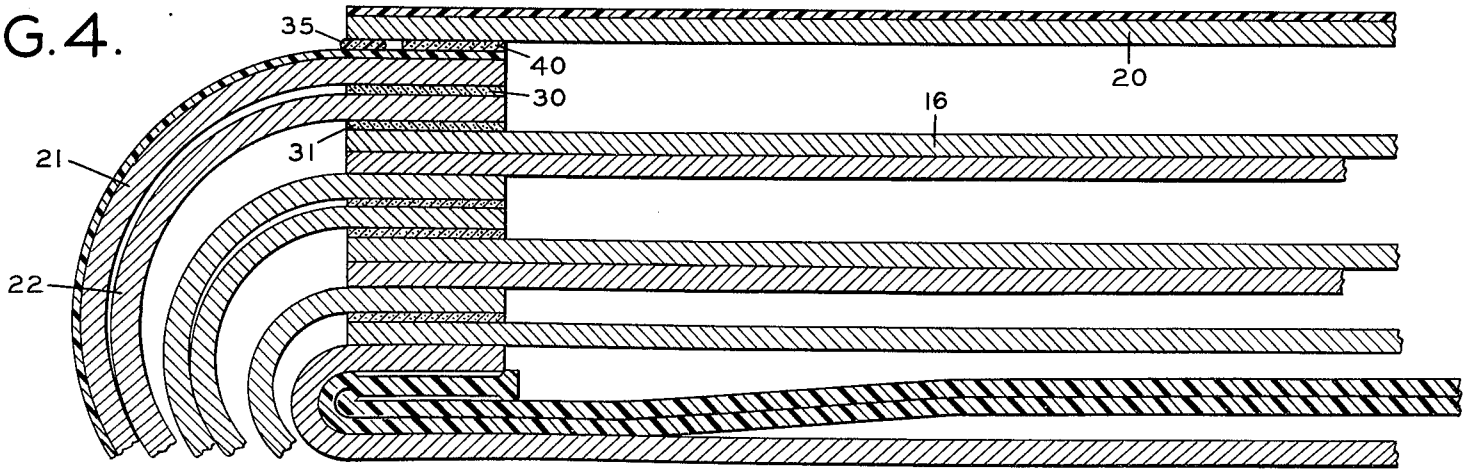
FIG. 4 is a fragmentary view, in section, of an alternate embodiment of my invention.

Referring to FIG. 4, there is shown a fragmentary view of a dunnage bag construction which is generally similar to the construction shown in FIG. 3 but which reflects an alternate embodiment of my invention. In the embodiment of FIG. 4, the outermost flap 21 and the penultimate flap 22 are disposed between the outermost ply 20 and the penultimate ply 16 as was the case with the embodiment of FIG. 3. A non-hot melt adhesive connection 31, such as a starch composition or a PVA composition, is used to adhesively connect the penultimate ply 16 to the inner surface of the penultimate flap 22 and to connect the outer surface of the penultimate flap 22 to the inner surface of the outermost flap 21, as at 30. Similarly, a hot melt adhesive 35 is supplied to insure a quick setting adhesive connection between the outermost flap 21 and the outermost ply 20. However, in contradistinction to my preferred embodiment as shown in FIG. 3, the embodiment of FIG. 4 provides a second adhesive connection 40 between the interior surface of the outermost ply 20 and the adjacent portion of the bag by supplying an adhesive connection with the outer surface of the outermost flap 21. As previously indicated, a standard adhesive such as starch or a PVA composition will not satisfactorily adhere to a thermoplastically coated surface. Thus, in order to insure that the non-hot melt standard adhesive adheres to the coated, outer surface of the outermost flap, this surface is subjected to an electrostatic treatment, such as a corona discharge. Thereby, an end closure construction is provided which will perform satisfactorily both at normal and elevated temperatures.

Figure 5:
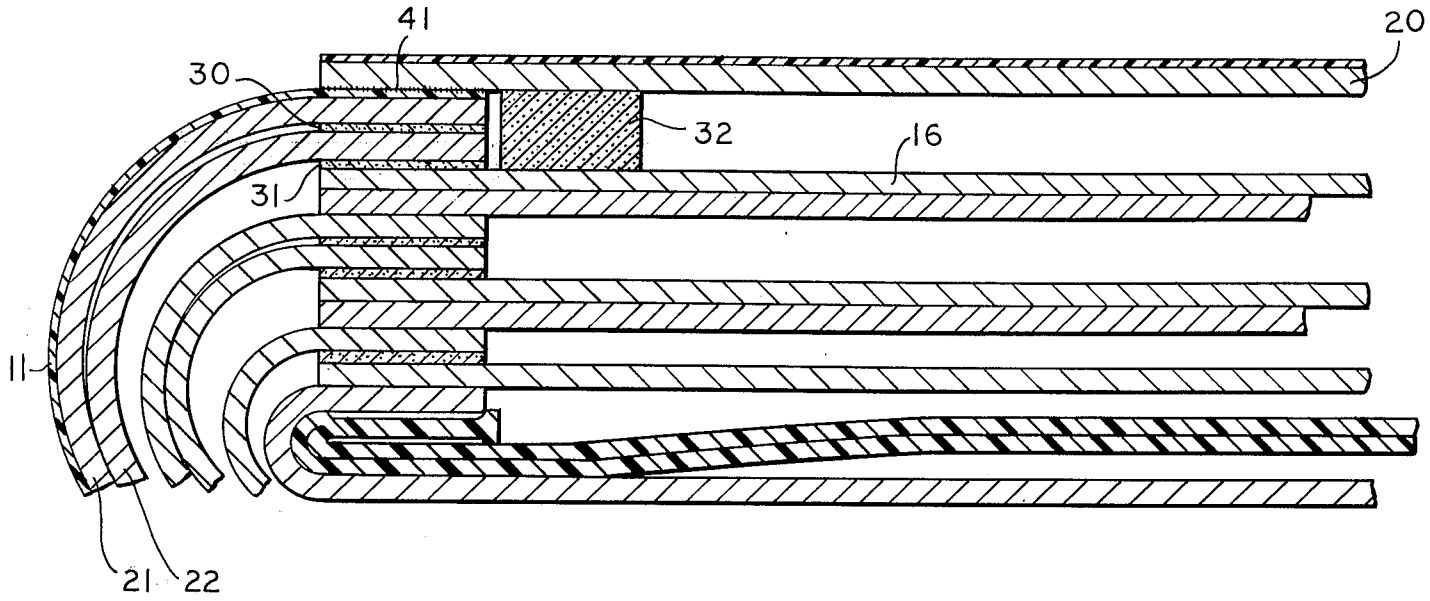
FIG. 5 is a fragmentary view, in section, of another embodiment of my invention.

An embodiment of my invention which is particularly desirable from a manufacturing point of view resides in substituting a heat seal connection for the hot melt connection outermost flap and ply. Thus, in this embodiment, as shown in FIG. 5, rather than using the hot melt connection 35 shown in FIGS. 3 and 4, the exterior thermoplastic coating on the outer surface of the outermost ply is advantageously employed. Thus, in this embodiment, the outermost flap is disposed beneath the outermost ply and sufficient heat and pressure are applied to that end of the bag so as to activate the thermoplastic coating 11 on the outer surface of the outermost flap, in the region where it abuts the inner surface of the outermost ply. After the thermoplastic coating on the outer surface of the outermost flap is activated or heated so that it is tacky, the outermost flap and ply are held in contact until the resulting heat seal adhesive connection 41 is set. As will be pointed out hereinafter, the disposition of the outermost flap beneath the outermost ply promotes the rapid attainment and maintenance of a secure bond. If the approach of using a heat seal connection is employed, the inner surface of the outermost ply may be adhesively secured to the outer surface of the penultimate ply by a standard adhesive as shown in FIG. 5 at 32.

It may be noted that in all of the embodiments of my invention hereinbefore discussed, the outermost flap is disposed beneath the outermost ply, i.e. the outer surface of the outermost flap is facing the inner surface of the outermost ply. Such a construction provides a number of advantages. For example, when the outermost flap is disposed beneath the outermost ply, it has been found that a more reliable bond is achieved. It is believed that this desirable result accrues from the fact the outermost flap displays a "spring back" tendency, i.e. after the outermost flap is initially disposed beneath the outermost ply the outermost flap appears to display a tendency to return to its flattened condition and this tendency appears to advantageously operate so as to hold the outermost flap against the outermost ply while the bond therebetween sets. In this manner, the natural tendency of the outermost flap to straighten out appears to insure an in-place solidification of the molten bond and thus a more reliable bonding as opposed to having the outermost flap on the outside of the outermost ply wherein the spring back of the outermost flap would tend to disengage or peel the molten bond when the heat and pressure of the bonding apparatus was removed.

Another benefit which accrues from disposing the outermost flap beneath the outermost ply resides in the fact that when the bag is inflated the internal pressure within the bag will urge the outermost flap against the outermost ply with the result that a frictional engagement between the surfaces thereof is promoted thereby contributing to a more positive bond than would be obtained if the outermost flap were disposed exteriorly of the outermost ply.

Additionally, when the outermost flap is disposed beneath the outermost ply, a more durable construction is obtained in that when a bag is used, there is a distinctly reduced probability that the two will be peeled apart during packaging, shipping or use.

Figure 6:
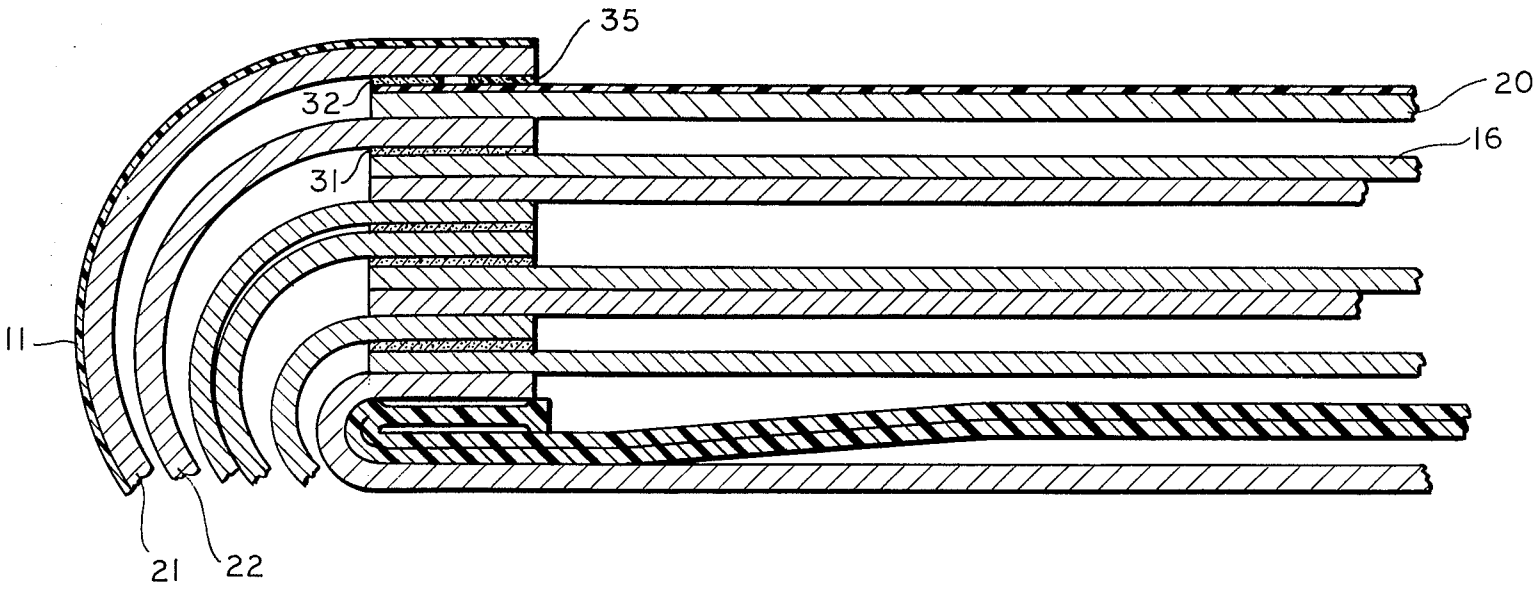
FIG. 6 is a fragmentary view, in section, of yet another embodiment of my invention.

Although it is generally desirable to position the outermost flap interiorally of the outermost ply as hereinbefore described and shown in FIGS. 3–5, it is possible to secure the benefits of this invention, i.e. resistance to creep, through the use of a construction wherein the outermost flap is disposed exteriorally of the outermost ply as shown in FIG. 6. More specifically, in FIG. 6 the outermost flap 21 is disposed exteriorally of the outermost ply 20 and is secured to the outermost ply 20 by a thermally activated adhesive 35, such as a hot melt adhesive, and by a non-thermally activated adhesive 32 such as a starch or PVA composition. Advantageously, the thermally activated adhesive 35 is located adjacent to the transverse edge of the outermost flap while the non-thermally activated adhesive is disposed adjacent to the transverse edge of the outermost ply.

As those skilled in the art will appreciate, the novel end closure construction hereinbefore described may be employed in combination with a variety of dunnage bag configurations wherein at least one end is closed by flaps which are adhesively secured to the plies of at least one wall. Thus, an end closure construction embodying my invention could advantageously be employed in combination with either of the basic dunnage bag constructions shown in FIGS. 1 and 2 or other prior art constructions.

I claim:

1. In combination with a dunnage bag having opposed, multi-ply walls wherein at least one end of said bag is closed by flaps which are adhesively secured to the plies of one wall and the outer surface of the outermost ply and the outer surface of the outermost flap are coated with a thermoplastic material, the improvement which comprises:

a. a thermally activated adhesive connection between the outermost flap and the outermost ply; and b. a first non-thermally activated adhesive connection, adjacent the end of said flaps, between the outermost ply and an adjacent portion of said bag.

2. The dunnage bag of claim 1 wherein said outermost flap is disposed interiorly of said outermost ply and said thermally activated adhesive connection connects the outer surface of said outermost flap to the inner surface of said outermost ply.

3. The dunnage bag of claim 2 wherein the inner surface of said outermost flap is connected to the outer surface of the penultimate flap by a non-thermally activated adhesive connection.

4. The dunnage bag of claim 3 wherein said first non-thermally activated adhesive connection connects the inner surface of the outermost ply with the outer surface of the penultimate ply.

5. The dunnage bag of claim 4 wherein said thermally activated adhesive is a hot melt adhesive.

6. The dunnage bag of claim 3 wherein said first non-thermally activated adhesive connection connects the inner surface of said outermost ply with the outer surface of said outermost flap.

7. The dunnage bag of claim 6 wherein said thermally activated adhesive is a hot melt adhesive.

8. The dunnage bag of claim 1 wherein said outermost flap is disposed exteriorly of said outermost ply.

9. The dunnage bag of claim 8 wherein said first non-thermally activated adhesive connection connects the inner surface of said outermost flap with the outer surface of said outermost ply.

10. The dunnage bag of claim 9 wherein said thermally activated adhesive connection is disposed adjacent the transverse edge of said outermost flap and said first non-thermally activated adhesive connection is disposed adjacent the transverse edge of said outermost ply.

* * * * *